United States Patent [19]

Mundell

[11] 4,191,424

[45] Mar. 4, 1980

[54] SUPPORT GRID FOR UPHOLSTERED SEATING

[75] Inventor: Donald D. Mundell, Carthage, Mo.

[73] Assignee: Flex-o-lators, Inc., Carthage, Mo.

[21] Appl. No.: 925,108

[22] Filed: Jul. 17, 1978

[51] Int. Cl.[2] ..... A47C 7/02

[52] U.S. Cl. ..... 297/459; 297/452

[58] Field of Search ..... 267/102–104; 297/452, 455, 458–460

[56] References Cited

U.S. PATENT DOCUMENTS

| | | | |
|---|---|---|---|
| 3,727,980 | 4/1973 | Tischler | 297/458 X |
| 3,762,770 | 10/1973 | Tedesco et al. | 297/458 X |
| 3,797,886 | 3/1974 | Griffiths | 297/458 X |
| 3,880,467 | 4/1975 | Tischler | 297/458 X |

*Primary Examiner*—James C. Mitchell

*Attorney, Agent, or Firm*—John A. Hamilton

[57] ABSTRACT

A support grid for upholstered seating of the "bucket" type, consisting of a series of closely space transversely extending spring cross wires defining the main cushion area of either a seat bottom or a seat back, connected at their respective ends to a pair of side spring wires, and angled upwardly and outwardly from the side wires to form the seat "wings" or bolsters, the novelty of the invention lying in the connection of the cross wires to the side wires, in which each cross wire has an S-bend formed therein in a plane normal to the main cushion area, the loop of the S-bend adjoining the main cushion area containing the associated side wire, whereby loading of the associated wing portion tends to open said loop rather than clamping it more tightly about the side wire, so that metal fatigue is reduced, and the other loop of the S-bend opening outwardly, tending to distribute the flexure strains along a longer section of the wire to further reduce metal fatigue, selection of the radius of curvature of this last named loop serving to adjust the stiffness or resistance to flexure of the wing portion. The grid may be used as a spring base for upholstery padding by suspending the side wires thereof resiliently from a rigid seating frame, or may be completely encapsulated in an elastic foam pad supported in a "pan" formed by the seating frame, in which case it serves as reinforcement for the pad.

6 Claims, 4 Drawing Figures

SUPPORT GRID FOR UPHOLSTERED SEATING

Figure 1:
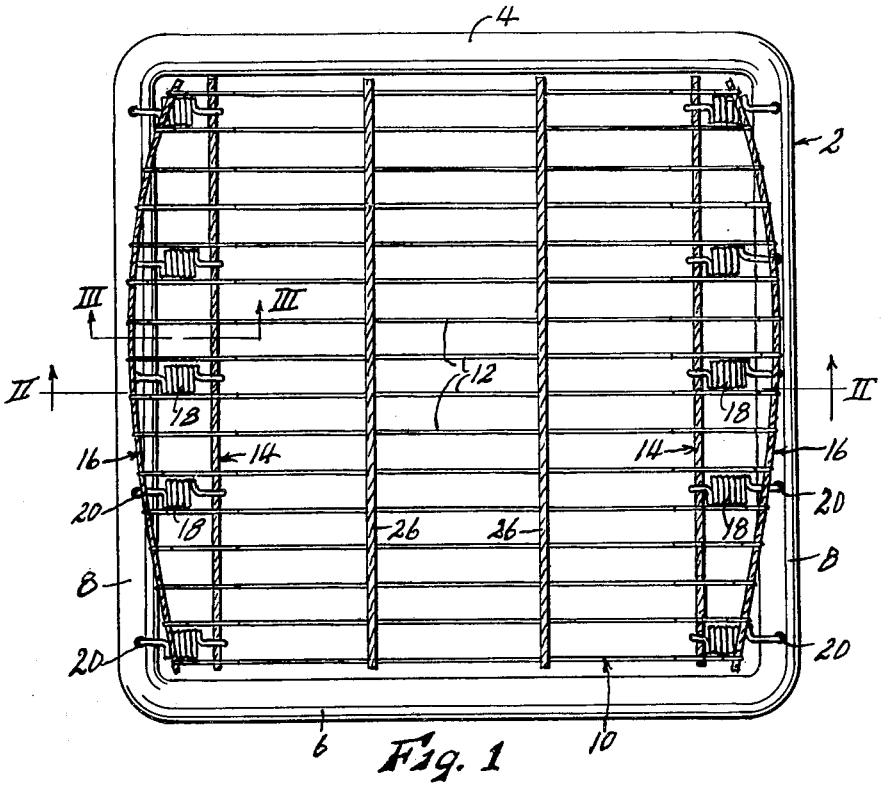

This invention relates to new and useful improvements in padding supports for upholstered seating structures, and has particular reference to seating structures, commonly employed in automotive usages, wherein a single-person seat is provided along its lateral or side edges with raised "wings" or bolsters. These wings tend to encourage the user to keep his weight better centered in the seat, provide side support for the hips and thighs of the user, thereby distributing his weight over a larger area of the seat with a consequent reduction in loading per unit of support area, and are generally considered more comfortable and desirable than flat or "bench" type seats. They are commonly and popularly referred to as "bucket" seats. And while the present invention will be described primarily in connection with seat "bottoms" as just described, it will be understood that similar structures are also used in seat backs, wherein they have the same advantages of centering, side support and weight distribution. The present invention is also applicable to seat backs.

Seat bottom or seat back cushions of the type described, that is, with wing portions inclined upwardly and outwardly from the central or main cushion area, are commonly supported by or formed over and reinforced by spring wire fabric grids of suitable form, that is, grids also having a generally planar area defining the main or central seating area, with upwardly and outwardly inclined side edge portions defining the wing areas. The padding layers may be applied over and secured to the grid, or the grid may be permanently encapsulated in a natural or synthetic foam padding material. The grid may be resiliently supported in a frame from the side edges of its main or central area, in which case the grid serves as a spring base for the padding. The present grid is usable in this application, which will be denoted herein as its "spring base" usage. Also, particularly when the grid is encapsulated in foam, the cushion may be simply rested and secured in a generally flat, rigid "pan" provided by the frame, in which case the grid serves primarily as reinforcement for the foam, although still providing a spring base for the wing portions. The present grid is also usable in this application, which will be denoted its "padding reinforcement" usage.

The provision of an effective spring grid for bucket seats of the type described has been a persistent problem in the automotive seating industry. A type enjoying growing popularity, having advantages of simplicity, economy, adaptability for production by automatic machinery, and general efficiency of operation, consists of a series of closely spaced parallel spring cross wires extending transversely of the seat and defining the main or central cushion area, connected adjacent the sides of the seat respectively to a pair of spring side wires extending transversely to the cross wires, and continuing from said side wires in upwardly and outwardly inclined relation to define the wing areas of the cushion. This grid is commonly permanently encapsulated in resilient foam padding material, or covered by fibrous padding material, and enclosed in a decorative trim sheet.

A recurring problem with this type of spring grid has been fatigue failure of the cross wires at or adjacent their points of connection to the side wires. The angularity between the main seat portion and the wing portion of each cross wire at this point, and the rigidity of the wire connection, said connection usually being made by wrapping the cross wire tightly around the side wire, inevitably results in the concentration of bending stresses at the connection when the wing portions are flexed downwardly as in normal usage. These stress concentrations result in fatigue, crystallization and eventual breakage of the cross wires, usually in the wing portion thereof directly adjacent its connection to the side wire, thereby shortening the effective lift of the unit.

Various attempts to solve this problem have been made. For example, knowing that the point of maximum stress concentration in the cross wire is its initial point of contact with the side wire, when the former is tightly twisted or wrapped about the latter, the side wire has been provided with a sheath of soft, indentable material, on the theory that the point of contact referred to would thereby be rendered yieldable, rather than unyieldable, and the bending stress would thereby be distributed along a longer length of the cross wire. However, while the sheath had other useful functions, such as providing good purchase for the cross wires thereon, and the elimination of wire noises, it was not particularly effective in reducing fatigue failures, probably because, in twisting the cross wire thereabout, the sheath itself was indented and compressed to such an extent that virtually no further compression thereof could occur in normal usage. Also, efforts have been made to reduce such wire breakage by providing a transverse offset portion in each cross wire at each side wire, the offset lying along and being loosely connected to the side wire, in the hope that the offset portion would yield in torsion, thereby distributing the strain along a longer portion of the wire. This idea has not been particularly successful either, apparently because it is not practically possible to make the offsets sufficiently long to provide enough torsional yield, with the result that breakage still occurred at the wire angles between the offset portions and the standing portions of the wires.

Accordingly, the principal object of the present invention is the provision of a connection between the cross wires and the side wires in a spring grid of the type described which is highly effective in reducing stress concentrations in the cross wires at the connections to a minimum, thereby greatly reducing fatiguing and breakage of said wires, and greatly increasing the useful life of the grid unit.

Another object is the provision of a wire connection of the character described providing a ready means for variably selecting the degree of resilient stiffness, or resistance to flexure, of the wing portions of the side wires.

A further object is the provision of a wire connection of the character described which allows snap-in assembly of the side wires with the cross wires, as an aid in the production and installation of the spring grid.

Generally, these objects are accomplished by forming a vertical S-bend in each cross wire, including a lower loop opening inwardly toward the main seating area, and an upper loop opening outwardly. Neither loop is closed. The side wire may be snapped into engagement with the lower loops, and the upper loops provide the desired upward and outward inclination of the wing portions of the cross wires. Thus it will be seen that when the wings are loaded downwardly as in normal usage, the stress tends to open the lower loops of the S-bends in which the side wire is disposed, rather than to close them, so that said lower loops do not clamp the side wire therein, but on the contrary actually tends to loosen their engagement around the side wire. Thus stresses are not concentrated at initial or final points of contact of the cross wires with the side wires, and the strain is freely distributed along the entire lengths of the S-bends. Variation of the radius of curvature of the upper loops of the S-bends provides a ready means for adjusting the resilient stiffness of the wing portions of the spring grid.

Other objects are extreme simplicity and economy of structure, ready adaptability for production by automatic machinery, and efficiency and dependability of operation.

Figure 2:
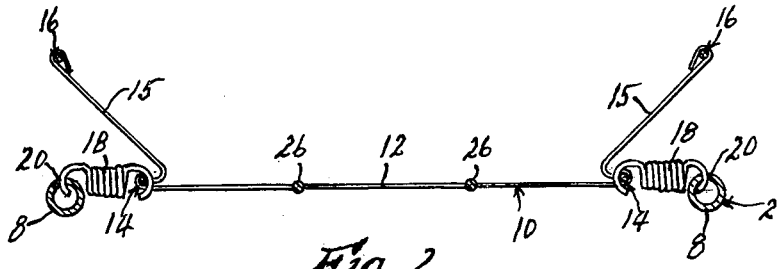
Figure 3:
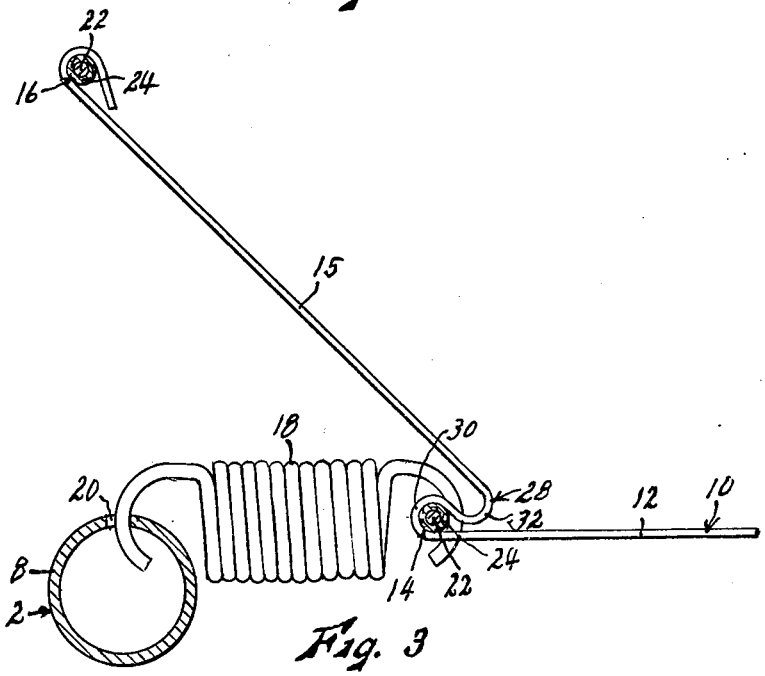
Figure 4:
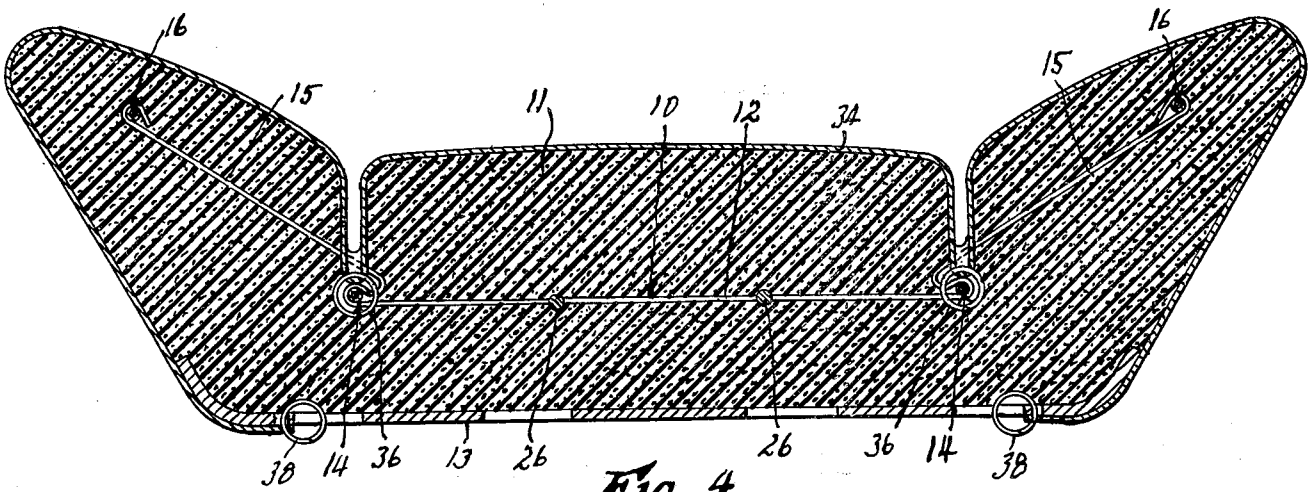

With these objects in view, as well as other objects which will appear in the course of the specification, reference will be had to the accompanying drawing, wherein:

FIG. 1 is a top plan view of a spring grid for upholstered seating embodying the present invention, shown applied to a seating frame for use as a spring base, FIG. 2 is a sectional view taken on line II—II of FIG. 1, FIG. 3 is an enlarged, fragmentary sectional view taken on line III—III of FIG. 1, and FIG. 4 is a view similar to FIG. 2 but showing the grid encapsulated in foam padding in its use as a padding reinforcement.

Like reference numerals apply to similar parts throughout the several views, and in FIGS. 1-3 the numeral 2 applies to a rigid seat frame. As shown, said frame is open, generally rectangular, and formed of tubular steel, having a front rail 4, rear rail 6, and generally parallel side rails 8. The use of frames of other materials and structures is optional, so long as they are open and have generally parallel side rails. This is the type of frame used when the grid to be described is to be resiliently supported from the frame in its use as a spring base. When the grid is to be encapsulated in a foam padding material 11 as shown in FIG. 4, to serve as a padding reinforcement, the frame may consist of a rigid, generally flat base pan 13 in which the reinforced foam pad is rested and secured. Also, while the grid will be described primarily in its use in a seat bottom, it can as previously mentioned also be used in seat backs, and therefore it will be understood that reference hereinafter to the "seating area" of the grid apply to the area thereof to which the load is normally applied, whether it be in a seat bottom or a seat back, and the references to "upward" and "outward" sloping of the wings mean sloping away from the edges of the seating area, and oppositely to the direction from which the load is applied to the seating area.

A spring grid designated generally by the numeral 10 includes a series of parallel, closely spaced apart spring wires 12 extending transversely across the seat frame. The respectively opposite end portions of all of said cross wires are connected to a pair of side strands 14 extending parallel to the sides of the frame, and are extended beyond said side strands in upwardly and outwardly inclined relation, as indicated at 15, the outer ends of said inclined wire portions, at each side of the grid, being secured to a border strand 16, as by being twisted tightly thereabout. If the grid is to be resiliently suspended from the frame itself, each side strand 14 is supported by a plurality of helical springs 18 extending parallel to the central portions of the cross wires, each spring being hooked at its inner end about the associated side strand 14, and connected at its outer end to the associated side frame 8, as by being hooked into a hole 20 provided therefor in said frame rail. The number and strength of springs 18 used is determined by the desired firmness of the grid. As shown in FIG. 3, each side strand 14 and border strand 16 comprises a core 22 of heavy spring wire, and a sheath 24 of soft, indentable material such as twisted paper or plastic. Border strands 16 need not be straight, but may be curved as indicated in FIG. 1 to provide a decorative edge configuration for the wings, or bolsters, of the seat. Cross wires 12 may also be connected by intermediate strands 26 disposed between and parallel to side strands 14. These intermediate strands are flexible, and may also be formed for example of twisted paper or plastic, being pierced by each of the cross wires at its point of intersection therewith, but need not have spring wire cores, since their primary function is merely to preserve a generally uniform spacing between the cross wires throughout their lengths. The portions of cross wires 12 between side strands 14 define, in skeleton form, a generally planar and horizontal main seating area, while the inclined end portions 15 of said cross wires define the wing or bolster portions of the grid. It will be understood that suitable layers of padding material may be applied over the grid and secured by a decorative trim sheet or the like applied over the padding, said trim sheet preferably being suitably secured to side strands 14 of the grid, and secured at its edges to frame 2. When the grid is encapsulated in foam pad 11 and the pad supported in a base "pan" 13 as in FIG. 4, the trim sheet 34 is applied over the foam, being drawn down into grooves formed therefor in the foam over side strands 14 and secured to said side strands by split ring fasteners 36 commonly known as "hog rings," and secured at its edges to pan 13 by hog rings 38. The grid as shown in FIGS. 1-3 could also be encapsulated in foam, with the foam cored out at intervals along its side edges to provide access for springs 18 to side strands 14.

The structure as thus far described is known in the prior art except for the specifics of the connection of cross wires 12 to side strands 14, which will presently be described in detail, and which form the central feature of the present invention. The connection is best shown in FIG. 3, and is provided by forming an S-bend designated generally by the numeral 28 in each cross wire 12 at each of said side strands. Said S-bend is disposed in a plane normal to the plane of the seating area and includes a lower loop 30 and an upper loop 32, formed by twice rebending the wire on itself. Lower loop 30 is sized to receive the associated side strand transversely therein as shown, and is not closed but remains slightly open, opening inwardly over the main seating area of the grid, so that the side strand may be snapped into engagement therein by partial opening of said loop. The side strand is then held firmly in said lower loops by the tension of springs 18 if said springs are used as in FIGS. 1-3, or by the near-closure of said loops when said springs are not used, as in FIG. 4. Upper loop 32 of the S-bend is of course generally reversed as compared to lower loop 30, and provides the desired slope for inclined wing portions 15 of the cross wires.

The operation of the wire connection is believed to be reasonably apparent from the foregoing description of its purposes and construction. When either wing portion of the grid is top-loaded, as occurs in normal usage, said load may be considered to be centered laterally outwardly from said strands 14, and the effect of said load, as relates to S-bends 28 of the cross wires, is a tendency to close the upper loops 32 thereof, and to open the lower loops 30 thereof. The opening and closing effect on the loops is of course only partial. The partial opening of lower loop 30 loosens its grip on the side strand. In fact, since the original radius of curvature of loop 30 is preferably about the same as that of the side strand, with its sheath uncompressed or only slightly compressed, the partial opening thereof under load as just described so loosens its grip on the side strand that said loop then engages said side strand with full pressure substantially only at a point of the loop generally directly opposite the horizontal portions of the cross wires, even when springs 18 are used.

Thus the bending stresses which necessarily must be concentrated at the junctures of the horizontal and inclined portions of the cross wires, due to the general angularity therebetween, are not concentrated at a single point or very short portion of each cross wire, but on the contrary are distributed generally evenly through the entire length of the wire involved it its S-bend. The upper loop 32 is of course free and open, so that strain or yield thereof can occur along its entire length, and lower loop 30, while it encloses the side strand, tends to open to some extent when the wings 15 are loaded, thereby reducing its engagement with the side strand to a substantial "point contact" as previously described. Moreover, this "point contact" is of a rocking nature, in that it "rolls" around the side strand in response to different degrees of loading, and any bending strains in the lower loop may be transmitted past the point of contact even into the lower portion of the lower loop. Essentially, the point here involved is that the cross wires are at no points of their lengths "immovably affixed" relative to the side strands. If they were so affixed, as they would be if they were tightly looped about the side strands, and/or if loading of the wings had the tendency to close the loops to clamp them still more firmly around the side strands, then the initial and final points of contact of each cross wire with the side strand would become a point of affixation, and bending stresses would be highly concentrated at these points. In break-down tests of prior structures having such points of affixation, such tests amounting to many thousands of consecutive loadings and unloadings of the cushions, eventual failure and breakage of the cross wires occurred at these points. Similar tests of the present structure clearly demonstrate a much longer useful life in otherwise similar structures. Of course, upper loops 32 assist the action of the lower loops, by absorbing a portion of the bending stresses which otherwise would have to be accomodated in the lower loops.

The resilient stiffness of the wing portions of the grid is of course independent of springs 18, and is determined both by the resilient stiffness of the wires themselves, and by the yieldability of their S-bends 28. The yieldability of the S-bends is affected primarily by the length thereof and by the radius of curvature of its loops. The radius of curvature of lower loops 30 is generally equal to or not greatly less than the radius of the side strand, although preferably slightly less if the side strand includes an indentable sheath 24, for reasons which will presently appear, and is therefore generally fixed. However, the curvature radius of upper loops 32 may readily be varied, and this provides a convenient means for producing wings of various degrees of resilient stiffness, loops 32 of shorter radius producing comparatively stiff wings, and loops of larger radius producing softer or more easily yieldable wings.

Although as previously discussed the sheaths 24 of side wires 22 have proven generally ineffective in preventing fatigue failure of the cross wires if said cross wires are twisted tightly thereabout, the use of said sheaths in the present structure is preferred for at least two other reasons. First, they provide good purchase for the cross wires on the side strands, in order to prevent slippage of loops 30 longitudinally along the side strands. This action is particularly effective if said loops indent the sheaths to some extent, and it is for this reason that when the sheaths are used, the normal internal diameters of loops 30 are preferably somewhat less than the normal external diameters of the sheaths. Second, said sheaths insulate the wire connections and prevent the rubbing or grating "wire noises" which would otherwise occur between the cross wires and side wires 22, and between said side wires and the hooks of springs 18. For the same reasons, sheaths 24 of border strands 16 are also preferred.

While I have shown and described a specific embodiment of my invention, it will be readily apparent that many minor changes of structure and operation could be made without departing from the spirit of the invention.

What I claim as new and desire to protect by Letters Patent is:

1. A support grid for an upholstered seat bottom or seat back structure having a transversely central main seating area and side wing portion seating areas at the sides of said main seating area and inclined outwardly and upwardly from said main seating area, said grid comprising a wire fabric including:

a. a series of closely spaced, generally parallel spring cross wires extending transversely of said seating structure, the central portions of said cross wires defining said main seating area, and the end portions of said cross wires being angled upwardly and outwardly to define said wing seating areas, each of said cross wires being twice rebent on itself at each side of said main seating area to form an S-bend disposed in a plane generally normal to said seating areas and each including an inwardly opening lower loop and an outwardly opening upper loop, and b. a pair of resilient side strands extending transversely to said cross wires respectively at each side of said main seating area and each confined in said inwardly opening lower loops of the S-bends of said cross wires at its associated side of said main seating area, the cross wires continuing outwardly from said upper loops to define said wing seating areas, whereby top-loading of said wing seating areas flexes said cross wires, tending to restrict said upper loops, expand said lower loops, and loosen the engagement of said side strands in said lower loops, said grid being covered by a layer of padding material.

2. The structure as recited in claim 1 wherein the portion of each of said cross wires rebent on itself to form each of said lower loops of said S-bends is spaced apart from the standing portion of said wire by a distance less than the diameter of the side strand engaged in said lower loop, whereby to assist in the retention of said side strand in said lower loop, and whereby said side strand may be snapped outwardly into engagement in said lower loop by manually pressing it through said narrowed opening to spread said lower loop resiliently.

3. The structure as recited in claim 1 wherein the upper loop of each of said S-bends is open and constriction thereof is unimpeded by any structural element disposed therein, and hence may be formed with any desired radius of curvature, whereby by proper selection of said radius, the resilient stiffness of the wing seating areas defined by the inclined portions of said cross wires may be pre-determined as necessary or desirable.

4. The structure as recited in claim 1 wherein each of said side strands comprises a spring wire core having a sheath of soft, indentable material, the normal internal diameter of each of the lower loops of the S-bends of said cross wires being slightly less than the normal diameter of the sheath of the side strand engaged therein, whereby to provide for the indentation of said sheath by said loops to inhibit slippage of said loops longitudinally along said side strands.

5. The structure as recited in claim 1 with the addition of:

a. an open frame having generally parallel side rails spaced outwardly from and generally parallel to the side strands of said grid, and b. a series of generally horizontal tension springs disposed along each side of said grid, each of said springs being connected at its inner end to the associated side strand of said grid and at its outer end to a side rail of said frame, whereby said grid is resiliently supported and serves as a spring deck for padding layers applied thereover.

6. The structure as recited in claim 1 wherein said seating structure comprises a pad of cushioning material, said grid being permanently encapsulated in said pad, and the main seating area of said pad is supported in a rigid, generally planar pan provided by a seating frame.

* * * * *